United States Patent [19]

Rasmussen

[11] 4,434,584

[45] Mar. 6, 1984

[54] TURRET BELT GRINDER

[76] Inventor: Aaron P. Rasmussen, 9606 Candy La., La Mesa, Calif. 92041

[21] Appl. No.: 284,018

[22] Filed: Jul. 16, 1981

[51] Int. Cl.[3] ..... B24B 21/12

[52] U.S. Cl. ..... 51/135 R; 51/147; 51/166 T

[58] Field of Search ..... 51/135 R, 135 BT, 147, 51/148, 166 T

[56] References Cited

U.S. PATENT DOCUMENTS

| | | | |
|---|---|---|---|
| 2,273,696 | 2/1942 | Ducker | 51/135 R |
| 2,489,811 | 11/1949 | Perkins | 51/147 |
| 2,841,927 | 7/1958 | Barnes | 51/147 |
| 3,110,989 | 11/1963 | Dawson et al. | 51/135 R |

*Primary Examiner*—Harold D. Whitehead
*Attorney, Agent, or Firm*—Charles C. Logan

[57] ABSTRACT

A turret belt grinder having multiple contact wheels of different diameters mounted on tooling support members that are adjustably attached to a turret frame. The turret assembly is rotatably supported on flanged bushings bearing on a ring plate to revolve 360 degrees about, and concentric to, the axis of the motor drive shaft. A closed loop belt is transported in a fixed geometric pattern on the radial surface of the contact wheels. Each of the contact wheels may be rotated to a common work station to produce infinite belt angles and chages in wheel diameters. A friction rotor lock functions to fix the turret position to accommodate a variety of abrasive machining applications. The abrasive belt is driven by a V-belt which transmits power from the motor shaft to a contact drive wheel. Wheel mount member assemblies provide adjustment of the V-belt tension, abrasive belt tension and belt tracking camber. A leverage spring release mechanism permits rapid abrasive belt changes and maintains belt tautness. It also provides a means for exchanging contact wheels to meet contouring specifications. The turret and motor supporting ring plate is attached by coupler bolts to the housing assembly which also functions to enclose, guard and dust evacuate the turret assembly. Adjustable sliding panels operate to further limit abrasive belt exposure at the work station opening. A hinged door provides access for belt changes and maintenance. Attached to the housing exterior is a mounting base and adjustable belt work rest.

13 Claims, 8 Drawing Figures

TURRET BELT GRINDER

BACKGROUND OF THE INVENTION

The invention relates to an abrasive belt grinding machine, and more specifically, to a turret belt grinder in which various diameter wheels, which are mounted on a turret frame and also located within a closed loop grinding belt, are resolved about a central drive motor axis to accomodate a variety of abrasive machining operations at a single work station.

The turret belt grinder is applicable to contour or flat work grinding of a variety of materials and provides options in wheel diameters and belt work angles unavailable in previous machine designs.

It is an object of the invention to provide an abrasive belt grinder with multiple tooling members.

It is also an object of the invention to provide a turret structure for moving the multiple tooling to a common work station.

It is also an object of the invention to provide maximum compactness in machine design by employing a common axis for the drive motor shaft and the turret assembly, so that the turret and tooling members are able to revolve 360 degrees about a mutual axis.

It is also an object of the invention to provide an external frictional brake design to lock the turret in an infinite number of rotary tooling positions.

It is also an object of the invention to provide a fixed path V-belt and abrasive belt pattern, eliminating adjustment requirements for both belts during rotational transitions.

It is also an object of the invention to provide ready access and quick change capability for abrasive belt replacement.

It is also an object of the invention to provide a wear compensating means for adjusting V-belt and abrasive belt tautness and for controlling belt tracking camber.

It is also an object of the invention to provide a quick change mechanism for the exchange of contact wheels to meetspecial contouring requirements.

It is also an object of the invention to house and adjustably guard portions of the abrasive belt not presently being utilized as a tooling structure.

It is a further object of the invention to provide adjustable platen and work rest mechanisms to further satisfy safety considerations.

It is an additional object of the invention to provide an enclosure and evacuation orifice for the collection and removal of abrasive waste products and dust.

It is a final object of the invention to incorporate the foregoing objectives in a high speed, low maintenance abrasive belt machine capable of contour or flat work grinding in a variety of off hand or work supported modes.

SUMMARY OF THE INVENTION

The novel turret belt grinder has been designed to revolve multiple sizes and types of tooling to a single work station in the simplest manner possible. The rotary principal provides tool versatility without the time consuming tooling exchanges normally associated with varying job requirements. The turret concept is ideally suited for belt grinders/sanders because it provides an infinite selection of belt angles and tool positions.

The turret frame is supported and rotates on flanged bushings bolted to the frame with shoulder bolts. The bushings track on the machined radial edge of a ring plate. Suspended on the bolts and separating the turret frame and ring plate are flat revolving spacer washers. These washers reduce the bearing surface area of the mating parts. A motor with drive pulley is bolted to the ring plate in a central position to insure a common axis of motor shaft with the ring plate. Finally, the ring plate is supported by coupler nuts and bolts to the support housing and mounting base.

The turret frame carries four tooling support members. The primary function of the members is to support the contact wheels that function to transport the closed loop abrasive belt over its fixed geometric pathway. In addition, each member is assigned a supplemental mechanistic task.

The drive belt tension control member supports the drive whell with attached V-pulley and adjusts the tension of the V-belt connecting the drivewheel and motor shaft pulleys.

The camber control member supports a crowned idler wheel and is adjustable to insure proper belt tracking alignment.

The pattern control member supports an idler wheel and compensates for any changes in tooling size by adjusting the travel pattern of the abrasive belt. The pressure release member supports an exchangeable idler wheel assembly, maintains a leveraged spring tension on the abrasive belt and functions to quick release the belt when the leverage arm is depressed.

Welded to the rear of the ring plate is a cylindrical turret lock. Within the bored end of the cylinder and penetrating the plate to bear on the turret surface is a sliding fit stop rod. At the threaded end, a lock screw engages the threads within the cylinder to depress the stop rod and friction lock the turret. A shoulder bolt and flange bushing is positioned on the opposite side of the ring plate to absorb the thrust of the stop rod and prevent distortion of the ring or turret. Completing the turret assembly is a shroud attached to the periphery of the frame to reinforce the structure and guard the frame members.

Supporting the ring plate and housing the turret assembly is the housing and mounting base. It is a semicircular structure featuring sliding panel guards at the worksite opening and a hinged door at the front side. At the rear, the motor extends through the housing and over the mounting base to provide additional housing support. Attached to the housing below the motor is a sliding work rest arm which supports an angle adjustable belt work rest.

DESCRIPTION OF THE PREFERRED EMBODIMENT

Figure 1A:
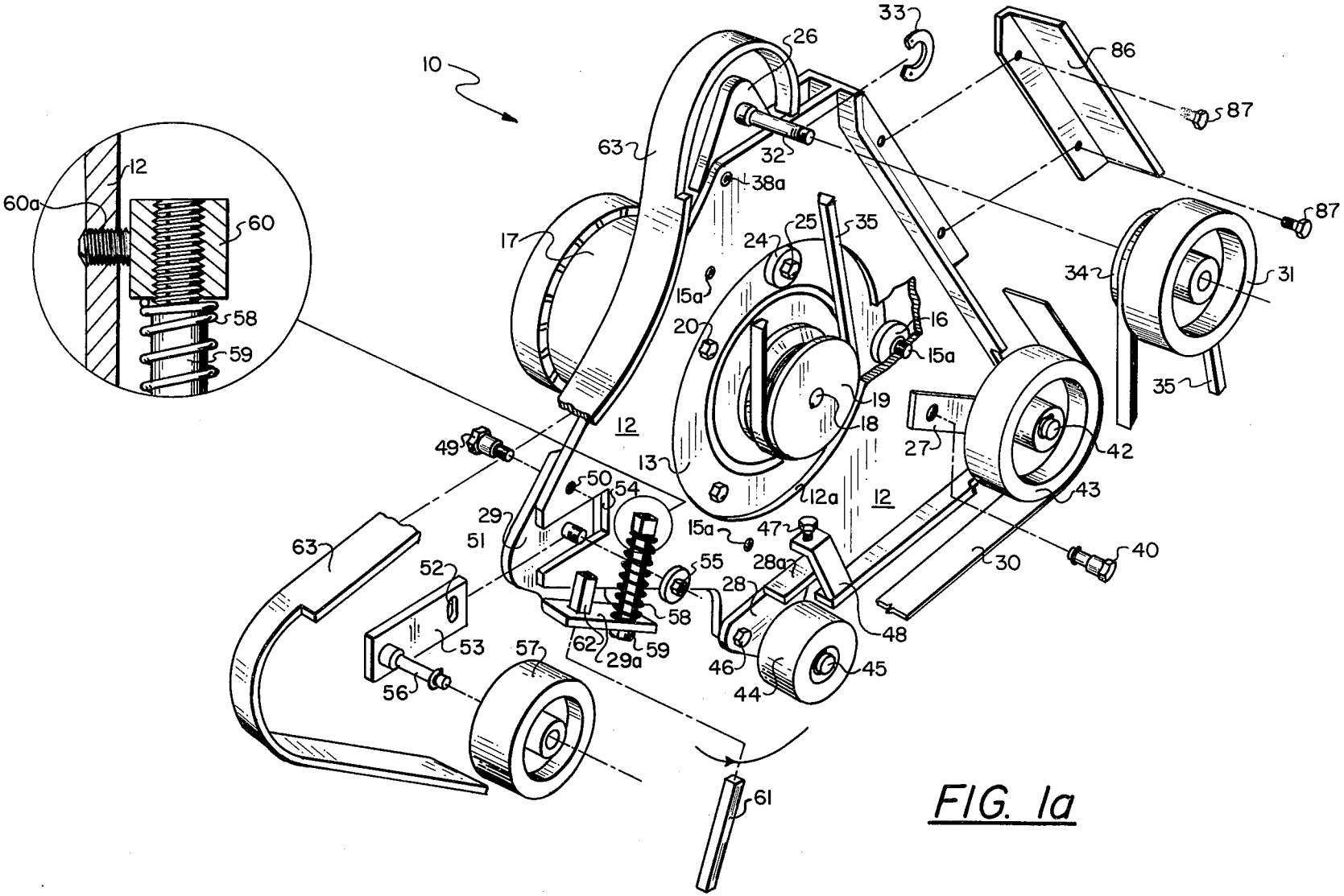
FIG. 1*a* is a partially exploded front perspective viewof the turret assembly portion of the turret belt grinder.
Figure 1B:
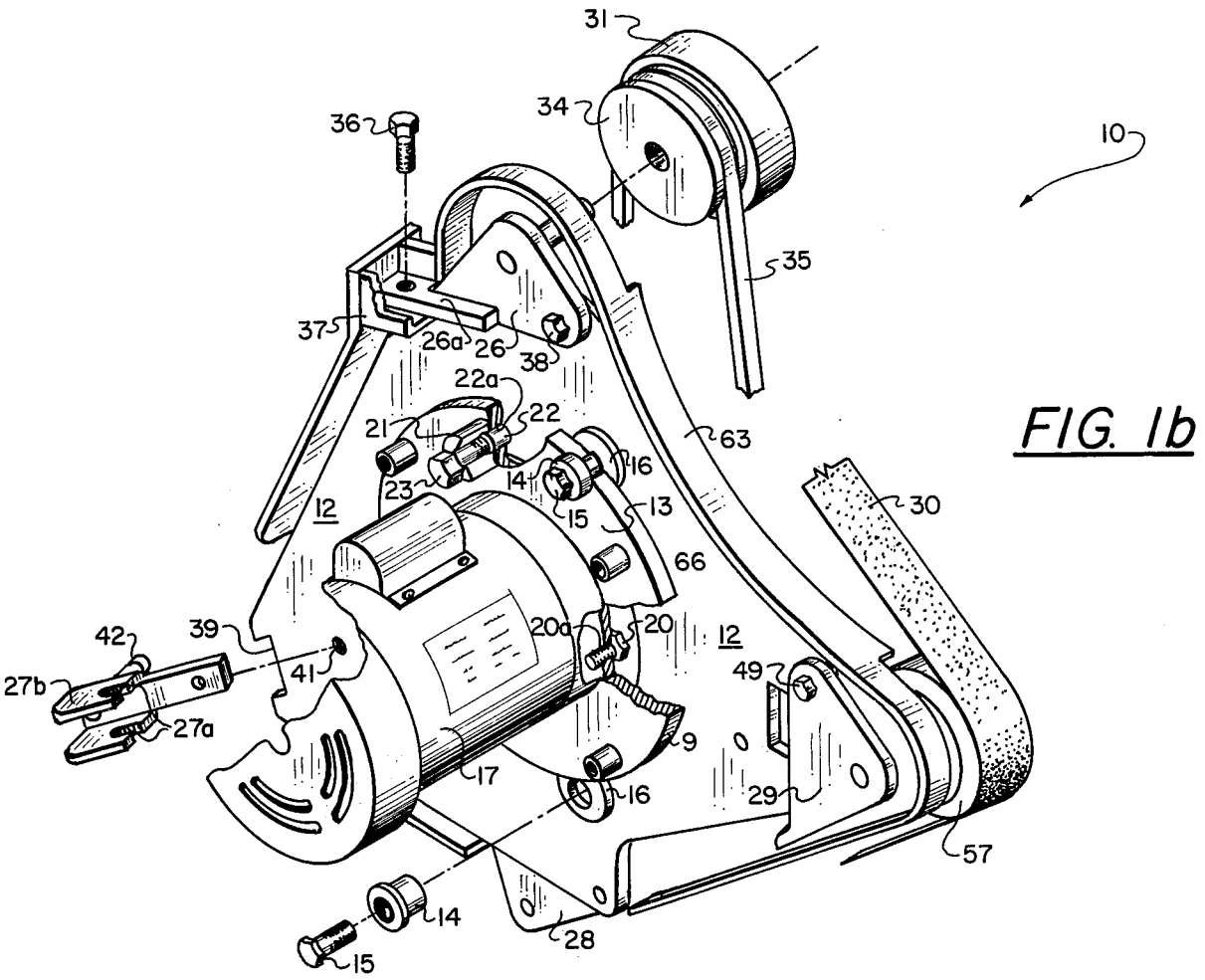
FIG. 1*b* is a partially exploded rear perspective viewof the turret assembly portion of the belt grinder.

The novel turret belt grinder assembly will now be described by the referring to FIGS. 1*a* and 1*b*. The turret belt grinder is generally designated numeral 10.

Turret belt grinder 10 has a turret frame 12 rotatably attached to ring plate 13 by three flanged bushings 14. The flange bushings 14 are secured to frame 12 by three equally spaced shoulder bolts 15 that are screwed into threaded bores 15*a* in turret frame 12. The flange bushings revolve on he bolts, acting as rollers, and track on the machined radial edge 9 of ring plate 13. Three hardened steel spacer washers 16 are suspended on the bolts to form a rotary bearing surface between turret frame 12 and ring plate 13. A drive motor 17, with motor shaft 18 and motor pulley 19, is bolted to the rear of ring plate 13 by means of four bolts 20 that are screwed into threaded bores 20*a*. Motor shaft 18 and ring plate 13 share a common x-axis permitting concentric travel of turret frame 12 about pulley 19.

Welded to the rear of ring plate 13 is cylindrical turret lock 21. At one end it is bored to accept a sliding fit stop rod 22 which extends through a bored hole 22*a* in ring plate 13 to bear on the surface of the turret plate. Clockwise rotation of lock screw 23, engaged in the threaded end of cylinder 21, extra lock, locks the turret frame 12 in any desired position in the manner of a set screw. Approximately 180 degrees opposite on the front surface of the ring plate 13, to prevent distortion by the lock thrust, is a flange bushing 24, fastened by shoulder bolt 25, to bear on the running edge 12*a* of turret frame 12 as a counterforce to deformation.

Turret frame 12 carries four tooling support members, a drive belt tension control member 26, a camber control member 27, a pattern control member 28 and a pressure release member 29. Each tooling member supports a different size contact wheel. In concert, they function to transport a closed loop grinding belt 30 on a fixed geometric path around the periphery of the wheel surfaces.

Drive control member 26 supports drive wheel 31 on axle 32, retained by keeper 33. Wheel 31 is driven by a wheel pulley 34 connected to motor pulley 19 by V-belt 35. The tautness of V-belt 35 is adjusted by drive adjuster screw 36 engaged in the threaded arm 26*a* of member 26 to bear against rigidly supported angle 37. Clockwise rotation of screw 36 causes member 26 to pivot on bolt 38 thereby producing belt tension. The common axis of motor shaft 18 and turret plate 12 assures equal belt tension thoughout the rotational cycle of the turret. When proper belt tension is achieved, bolt 38 is tightened and the assembly is locked in position.

Camber control member 27 is a stamped leverage bar having notches 27*a* in its yoke 27*b* that pivot on a mating slot 39 in turret frame 12. Reduced step screw 40 is threaded through control member 27 and forms a contained running fit in hole 41 of turret frame 12. Camber adjustments are obtained by rotating screw 40 in the threaded bore in camber control member 27 causing that member to pivot on the established fulcrum. The resulting movement is transmitted to axle 42 and crowned idler wheel 43 to direct belt tracking alignment for the turret assembly.

Pattern control member 28 supports idler 44 on axle 45. It pivots on bolt 46 which is threaded to penetrate frame 12. Abrasive belt pattern adjustments may be accomplished by rotating screw 47 through the threaded hole in welded angle 48 to bear on arm 28*a* of pattern control member 28. Pattern adjustment is required when changes in diameter require pathway compensation. Subsequent to pattern adjustment, bolt 46 is tightened to fix member 28 in locked position.

Pressure release member 29 supports a replaceable release arm 53, axle 56 and idler wheel 57. Pressure release member 29 pivots on shoulder bolt 49 which is threaded in hole 50. Bolt 51 is welded to a lateral face of pressure release member 29 to engage a slotted hole 52 in relase arm 53. Arm 53 is retained in a sliding fit with sot 54 by lock nut 55. Release arm 53, axle 56 and idler wheel 57 may be exchanged as a unit for similar wheel units of different form or diameter. Such tooling changes require adjustment of pattern control member 28 and camber control member 27. Bearing against member 29 and providing tension for the abrasive belt is spring 58. Spring tension and alignment is achieved as bolt 59 penetrates a hole in arm 29, extends through the bore of spring 58 and exits to adjustably screw into block 60. Block 60, in turn, is threaded into a hole 60*a* in turret frame 12 which permits rotation of block 60 as arm 29*a* is pivotally depressed. Belt changes are accomplished by inserting wrench 61 through a hole in arm 29*a* to insert in bearing sleeve 62. Exerting wrench force in a counterclockwise direction depresses spring tension and slacks the belt.

Thus, it can be observed that pressure release member 29 enables quick release of the belt, permits changes in tooling, and provides a leveraged spring system for achieving abrasive belt tension. Surrounding the turret assembly, is a shroud 63 which functions to reinforce the frame, afford attachment structure and guard the assembly members.

Figure 2:
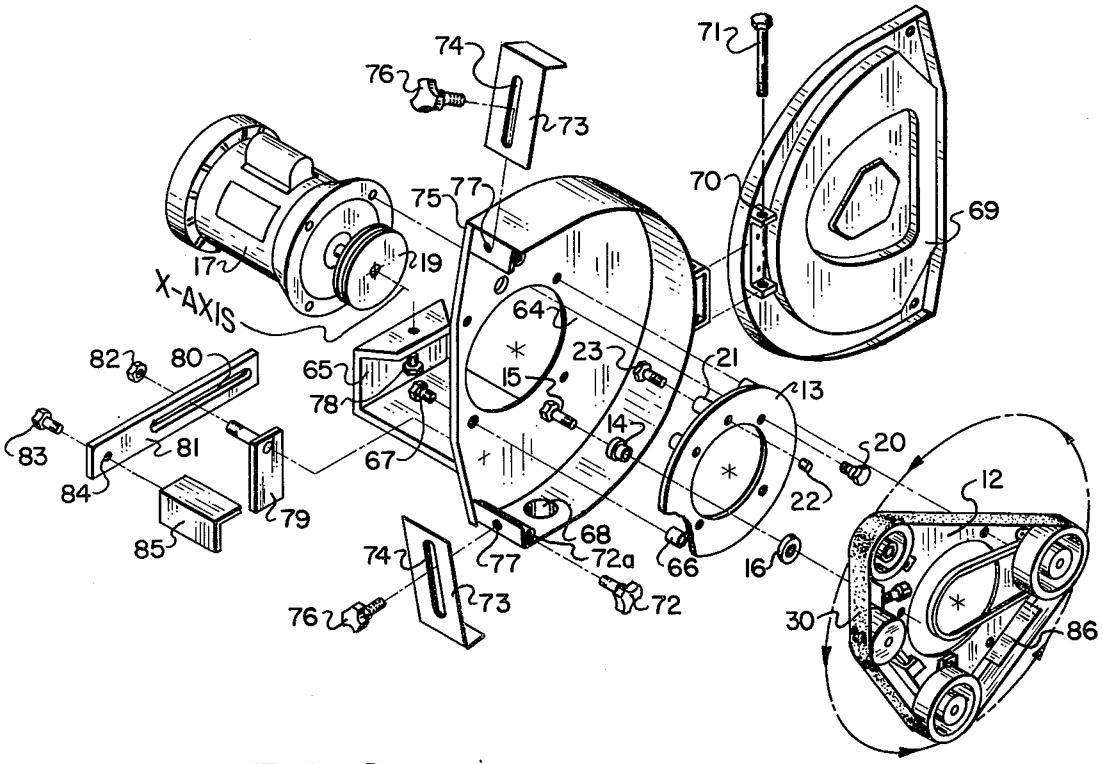
FIG. 2 is an exploded view of the turret belt grinder and housing assembly.

Supporting ring plate 13, and hence the turret assembly, is a semicircular housing 64 and mounting base 65 (see FIG. 2). Four attachment couplers 66, welded on the back of ring plate 13, and four bolts 67 secure ring plate 13 to housing 64. An exhuast duct 68, at the base of the housing enclosure permits evacuation of abrasive residue. On the housing face, a door 69 with hinge 70, hinge pin 71 and thumbscrew fasteners 72, provides access for belt exchanges or turret adjustments. At the front of the housing, sliding closure panels 73 operate to adjustably limit the worksite opening as turret position dictates. Slot 74 in panels 73 and a tracking angle 75 guide the panels in their reciprocal path. Thumbscrews 76 penetrate slots 74 to thread into tapped holes 77 to lock the panels in position.

Extending through the rear of housing 64, drive motor 17 is fastened to mounting base 65 with a single bolt 78. Beneath the motor, and weldment attached to the housing exterior, is post bar 79. The post shaft engages slot 80 in work rest arm 81 to permit rotational and reciprocal adjustment of that arm. Nut 82 locks arm 81 in position. Bolt 83 penetrates hole 84 in work rest arm 81 and threads into the work rest 85. Work rest 85 is pivotally adjustable and is locked in fixed position by tightening bolt 83. Supplementing the workpiece support function is back-up platen 86, slotted to adjustably attach to turret frame 12 with threaded fastener bolts 87.

Figure 4B:
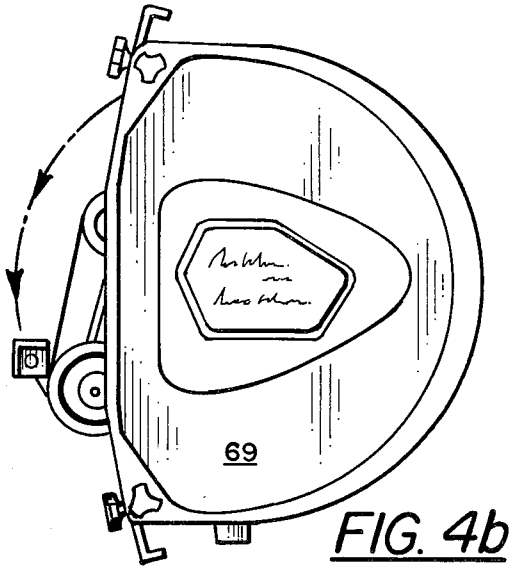
FIGS. 4*a* and 4*b* illustrate progressive rotation of the turret within the housing structure.
Figure 4A:
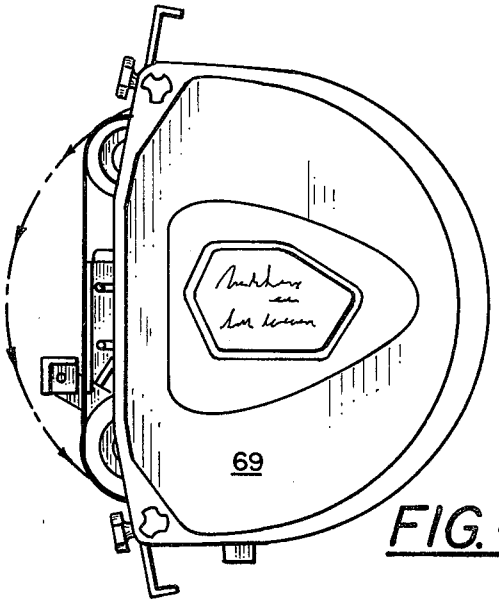

In operation, the motor 12 drives a closed loop grinding belt 30, by a power train earlier described to traverse a fixed geometric travel pattern. Four turret frame assembly members 26, 27, 28 and 29 transport the belt and accomodate machine adjustment. The turret frame 12 is rotationally mounted concentric with the motor axis to bring the multiple tooling members and various belt positions to a common work staion here they may be fixed in position with cylinder lock 21. FIGS. 4*a* and 4*b* illustrate the turret revolution within the housing enclosure.

Figure 3C:
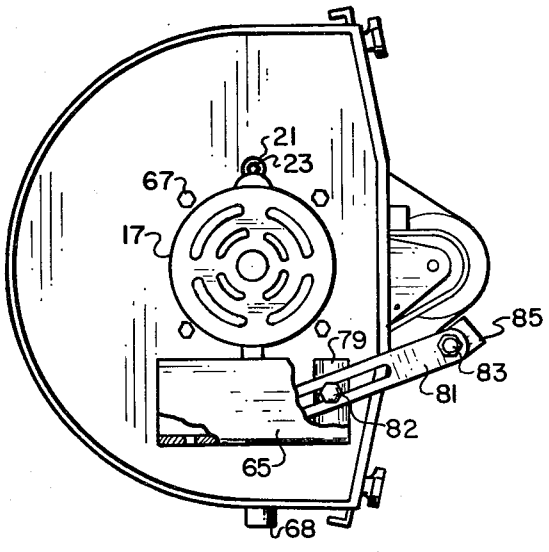
FIG. 3*c* is an orthographic revolution of the housing assembly shown in FIG. 3*b*.
Figure 3B:
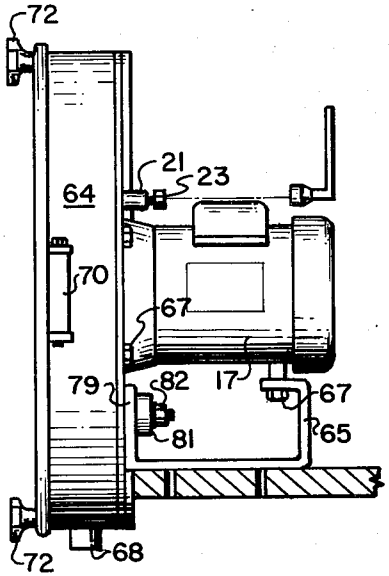
FIG. 3*b* is an orthographic revolution of the housing assembly shown in FIG. 3*a* with the door unit closed.
Figure 3A:
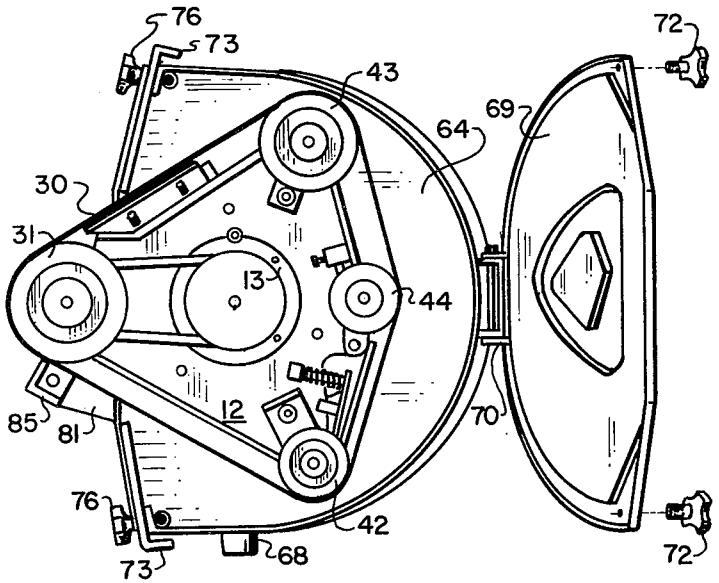
FIG. 3*a* is an orthographic view of the turret within the housing assembly with the door unit open.

In FIG. 3*a*, the novel turret belt grinder is illustrated with the door 69 of housing 64 swung open to reveal the structure within its interior. FIG. 3*b* illustrates the novel turret belt grinder from its rear and shows the door 69 in its closed position. FIG. 3*c* shows the housing 64 of the turret belt grinder as viewed along the axis of the drive motor 17.

What is claimed is:

1. A turret belt grinder comprising:

a drive shaft having a longitudinal x-axis;

means for rotating said drive shaft;

a turret frame oriented substantially perpendicular to said drive shaft;

a ring plate fixedly mounted with respect to said means for rotating said drive shaft, said drive shaft and said ring plate sharing a common axis;

means for rotating said turret frame through 360 degrees which maintains it with 360 degrees rotational concentricity with the x-axis of said drive shaft comprising at least three flanged bushings each of which is secured to the rear surface of said turret frame at a predetermined point by a shoulder bolt, said flanged bushings revolve on said bolts thereby acting as rollers and track on the radial edge of said ring plate;

at least three wheels, each of which is rotatably mounted on its own individual axle;

means for mounting said axles on said turret frame at points laterally spaced from one another and said axles being oriented substantially parallel to the axis of said drive shaft;

a closed loop grinding belt passing around the perimeter of the geometric configuration formed by said laterally spaced wheels;

one of said plurality of wheels being a drive wheel; and means for transmitting the rotational motion of said driveshaft to said drive wheel to rotate it, thereby driving said grinding belt around its closed loop path.

2. A turret belt grinder as recited in claim 1 wherein said turret frame has a substantially vertical orientation.

3. A turret belt grinder as recited in claim 1 wherein said turret frame has a central aperture through which passes said drive shaft.

4. A turret belt grinder as recited in claim 3 wherein said turret frame is in the form of a flat plate.

5. A turret belt grinder as recited in claim 1 wherein said means for transmitting the rotational motion of said driveshaft to said drive wheel comprises a pulley mounted on said drive shaft, a pulley mounted on the same axle that said drive wheel is mounted on, and a V-belt passing around said pulleys.

6. A turret belt grinder as recited in claim 1 wherein the means for mounting one of said wheel axles comprises a drive belt tension control member pivotally connected to said turret frame.

7. A turret belt grinder as recited in claim 1 whereint he means for mounting one of said wheel axles coprises an idler wheel camber control member connected to said turret frame for adjusting the grinding belt tracking alignment.

8. A turret belt grinder as recited in claim 1 wherein the means for mounting one of said wheel axles comprises a pattern control member pivotally connected to said turret frame for adjusting the travel pattern of the grinding belt to compensate for any changes resulting from changing any of the existing wheels for wheels of a different diameter.

9. A turret belt grinder as recited in claim 1 wherein the means for mounting one of said wheel axles comprises a pressure release member pivotally connected to said turret frame for maintaining tension on said grinding belt and functions to quick release said grinding belt when a different grinding belt is needed.

10. A turret belt grinder as recited in claim 1 wherein the means for mounting said axles on said turret frame comprises the following structure for mounting one of said wheels: a reciprocating support arm in mechanical linkage with a spring activated cam lever, said cam lever, together with enabling hardware, provides a leverage force on said wheel with means for releasing said abrasive belt and for exchanging wheels of various diameter.

11. A turret belt grinder as recited in claim 1 further comprising means for supporting a workpiece during grinding operations having a universal work rest with means for reciprocally adjusting extension and pivotally adjusting elevation and angle of said workrest.

12. A turret belt grinder comprising:

a drive shaft having a longitudinal x-axis;

means for rotating said drive shaft;

a turret frame oriented substantially perpendicular to said drive shaft;

means for rotating said turret frame which maintains it with 360 degree rotational concentricity with the x-axis of said drive shaft comprising;

a ring plate having its rear surface secured to one end of said means for rotating said drive shaft, said drive shaft and said ring plate sharing a common axis;

at least three flanged bushings each of which is secured to the rear surface of said turret frame at a predetermined point by a shoulder bolt, said flanged bushings revolve on said bolts thereby acting as rollers and track on the radial edge of said ring plate, each of said shoulder bolts also has a spacer washer suspended on it to form a rotary bearing surface between said turret frame and said ring plate;

a plurality of wheels rotatably mounted on their own individual axles;

means for mounting said axles on said turret frame at points laterally spaced from one another and said axles being oriented substantially parallel to the axis of said drive shaft;

a closed loop grinding belt passing around the perimeter of the geometric configuration formed by said laterally spaced wheels;

one of said plurality of wheels being a drive wheel; and means for transmitting the rotational motion of said driveshaft to said drive wheel to rotate it, thereby, driving said grinding belt around its closed loop path.

13. A turret belt grinder as recited in claim 12 further comprising means for locking said turret frame into any desired position within its 360 degree rotational range.

* * * * *